US012796875B2

(12) United States Patent
Pandya et al.

(10) Patent No.: US 12,796,875 B2
(45) Date of Patent: Nov. 17, 2026

(54) SPECIALIZED SCRUBBING BRUSH FOR CLEANING HIGH RISE WINDOWS AND OTHER HARD SURFACES

(71) Applicant: WCB ROBOTICS INC., Dover, DE (US)

(72) Inventors: Yash Pandya, Dungarpur (IN); Ujjawal Aggarwal, Lucknow (IN)

(73) Assignee: WCB ROBOTICS INC., Dover, DE (US)

( * ) Notice: Subject to any disclaimer, the term of this patent is extended or adjusted under 35 U.S.C. 154(b) by 303 days.

(21) Appl. No.: 18/694,131

(22) PCT Filed: Sep. 21, 2022

(86) PCT No.: PCT/IN2022/050839
§ 371 (c)(1),
(2) Date: Mar. 21, 2024

(87) PCT Pub. No.: WO2023/047412
PCT Pub. Date: Mar. 30, 2023

(65) Prior Publication Data

US 2024/0398185 A1 Dec. 5, 2024

(30) Foreign Application Priority Data

Sep. 22, 2021 (IN) ..... 202141042993

(51) Int. Cl.
*A47L 1/02* (2006.01)
*A46B 5/00* (2006.01)
(Continued)

(52) U.S. Cl.
CPC ..... *A47L 1/02* (2013.01); *A46B 5/0012* (2013.01); *A46B 5/06* (2013.01); *A46B 11/063* (2013.01);
(Continued)

(58) Field of Classification Search
CPC ..... A47L 2001/06; A47L 1/02; A46B 2200/3073; A46B 13/04; A46B 11/063; A46B 5/06; A46B 5/0012
(Continued)

(56) References Cited

U.S. PATENT DOCUMENTS 3,942,213 A 3/1976 Hoener, Jr.

FOREIGN PATENT DOCUMENTS

CN 108042046 A * 5/2018 ..... A47L 1/02
CN 108685520 A 10/2018
(Continued)

OTHER PUBLICATIONS

International Search Report dated Nov. 15, 2022, for corresponding International Application No. PCT/IN2022/050839, filed Sep. 21, 2022.
(Continued)

*Primary Examiner* — Katina N. Henson
(74) *Attorney, Agent, or Firm* — David D. Brush; Westman, Champlin & Koehler, P.A.

(57) ABSTRACT

A specialized scrubbing brush for cleaning high rise windows and other hard surfaces. The specialized scrubbing brush includes a pair of cleaning pads, one or more attachment gaps between the each of the cleaning pads, an axis of rotation, one or more water pipes, one or more water channels, a plurality of water holes and an interface surface between the pair of cleaning pads. Further, cleaning equipment is provided which includes the specialized scrubbing brush along with a pair of oscillating arms with a sliding yoke, a pair of rod shaped guide rails, an oscillation mechanism and a rotation mechanism. The scrubbing brush cleans automatically and is able to scrub a surface from corner to corner and is able to change from one scrubbing pad to another without human intervention.

12 Claims, 8 Drawing Sheets

(51) Int. Cl.
*A46B 5/06* (2006.01)
*A46B 11/06* (2006.01)
*A46B 13/04* (2006.01)

(52) U.S. Cl.
CPC ..... *A46B 13/04* (2013.01); *A46B 2200/3073* (2013.01); *A47L 2201/06* (2013.01)

(58) Field of Classification Search
USPC ..... 15/50.2
See application file for complete search history.

(56) References Cited

FOREIGN PATENT DOCUMENTS

| | | | |
|---|---|---|---|
| CN | 113069053 | A | 7/2021 |
| WO | 2018120291 | A1 | 7/2018 |

OTHER PUBLICATIONS

Written Opinion of the International Searching Authority dated Nov. 15, 2022, for corresponding International Application No. PCT/IN2022/050839, filed Sep. 21, 2022.

* cited by examiner

SPECIALIZED SCRUBBING BRUSH FOR CLEANING HIGH RISE WINDOWS AND OTHER HARD SURFACES

RELATED PATENT APPLICATION(S)

This application is a Section 371 National Stage Application of International Application No. PCT/IN2022/050839, filed on Sep. 21, 2022, and published as WO 2023/047412 A1 on Mar. 30, 2023, in English, which claims the priority to and benefit of Indian Provisional Patent Application No. 202141042993, filed on Sep. 22, 2021; the disclosures of which are incorporated herein by reference in their entireties.

FIELD OF THE INVENTION

The present invention belongs to the field of cleaning equipment. Specifically, the invention relates to cleaning brush and a cleaning equipment employing the said brush for cleaning windows and other surfaces. More specifically, the present invention relates to specialized scrubbing brush for cleaning high rise windows and other hard surfaces. The device automatically cleans the surfaces and is able to scrub a surface from corner to corner and able to change from one scrubbing pad to another without human intervention.

BACKGROUND OF THE INVENTION

Most robots that are available presently to clean various hard surfaces have any of the three systems: 1) a rotating pad, 2) an oscillating/vibrating pad or multiple pads, and 3) a stationary pad. These systems provide various limitations. A rotating pad is simple mechanically operable cleaning device which does one of the best scrubbings but is unable to reach corners on a polygonal surface. Oscillating pad/pads are very good at scrubbing and can reach the corners in most polygonal surfaces. If the polygonal surface is made up of orthogonal edges, an oscillating pad shaped like a rectangle can reach the corners and edges well. A stationary pad is simple but doesn't clean well.

When looking in context of designing for a facade cleaning operation, a number of points must be noted. Human window cleaners scrub a soap solution from corner to corner and then use a squeegee to wipe the window clean. They then use a dry cloth to wipe the edges to avoid even the last drop of water that may be left on the glass. In places with bird poop or hard water marks, a window cleaner may use a different type of cloth or pad (bronze pad etc.).

A mechanical system that is able to achieve all that a human cleaner can, does require the capability to scrub a surface with multiple types of cleaning pads including at least a wet-pad and a dry-cleaning pad.

U.S. Pat. No. 3,942,213 discloses window wall washing device for high-rise buildings. The wall washing device is provided with self-contained liquid spray means, wall and window surface scrubbing means and means for providing a curtain of high velocity, in-rushing air around a wall washing sight. The high velocity, in-rushing air curtain is delivered through a perimeter aperture which is spaced-apart from the window/wall surfaces; and is provided by forcibly drawing atmospheric air inwardly at the perimeter of the wall washing sight in accordance with a second embodiment. However, in the said prior art the brushes and sponges are of only one type. They does not have the capability to scrub a surface with multiple types of cleaning pads including at least a wet-pad and a dry-cleaning pad.

Further, a Chinese Patent Application No. CN108685520 discloses a kind of glass cleaning device with spraying function. The device includes a fuselage, scrub head is installed at the top of fuselage, the bottom of scrub head is equipped with movable axis, one end of movable axis is connected with supporting rod, nozzle is installed at the top of supporting rod, one end of supporting rod is equipped with accumulator, the bottom of accumulator is equipped with light-duty handle, one end of light-duty handle is equipped with model selection rotating cylinder, and one end of model selection rotating cylinder is equipped with control panel, and control panel bottom is equipped with holding rod, the side of holding rod is equipped with filler, and fixes sleeve is installed in the bottom of holding rod. However, they does not have the capability to scrub a surface with multiple types of cleaning pads including at least a wet-pad and a dry-cleaning pad.

LIMITATIONS OF KNOWN ART

Cleaning brush of known art does not have the capability of scrubbing a surface from corner to corner while also not being able to change from one scrubbing pad to another without human intervention.

Therefore, there is a need to provide a cleaning brush for automatic cleaning equipment wherein a cleaning pad has the capability to clean from corner to corner, has the capability to continuously keep one or more scrubbing pads wet and has capability to switch from one scrubbing pad to another without human intervention.

OBJECT(S) OF THE INVENTION

The primary object of the present invention is to provide specialized scrubbing brush for cleaning high rise windows and other hard surfaces.

Another object of the present invention is to provide the specialized scrubbing brush having cleaning pads of various types and each pad having plurality of scrubbing pads.

Another object of the present invention is to provide an automatic cleaning equipment with specialized scrubbing brush having cleaning pads of various types and each pad having plurality of scrubbing pads.

Another object of the present invention is to provide a cleaning pad that cleans from corner to corner and has capability to continuously keep one or more scrubbing pads wet.

Another object of the present invention is to provide a specialized scrubbing brush and an automatic cleaning equipment with specialized scrubbing brush having cleaning pads of various types which has capability to switch from one scrubbing pad to another without human intervention.

Yet another object of the invention is to provide a specialized scrubbing brush and a cleaning equipment with specialized scrubbing brush wherein the surface of the cleaning brush has the provision of supplying water/cleaning fluid.

SUMMARY OF THE INVENTION

Accordingly, the present invention provides specialized scrubbing brush for cleaning high rise windows and other hard surfaces. The specialized scrubbing brush comprises of cleaning pads of various types and each pad having plurality of scrubbing pads. The provided cleaning pads cleans the high-rise windows and other hard surfaces from corner to corner and the equipment has capability to continuously keep one or more scrubbing pads wet.

Further, the provided cleaning equipment with the said specialized scrubbing brush for cleaning high rise windows and other hard surfaces is automatic. The said automatic cleaning equipment with specialized scrubbing brush having cleaning pads of various types has capability to switch from one scrubbing pad to another without human intervention and in the cleaning equipment with specialized scrubbing brush, the surface of the cleaning brush has the provision of supplying water/cleaning fluid.

In one aspect of the present invention, the invention provides a specialized scrubbing brush (100) for cleaning high-rise windows and other hard surfaces, wherein the specialized scrubbing brush (100) comprising:

a pair of cleaning pad (1, 1');

one or more attachment gaps (2, 2') between the each of the cleaning pad (1 or 1');

an axis of rotation (3);

one or more water pipes (4);

one or more water channels (5);

plurality of water holes (6); and an interface surface (7) between the pair of cleaning pad (1, 1'), wherein the one or more attachment gaps (2, 2') between the each of the cleaning pad (1, 1') are provided to attach the cleaning pads (1, 1') to an external system;

wherein the specialized scrubbing brush (100) comprising of a multiple scrubbing pads (15) mounted on the pair of cleaning pads (1, 1') and the said brush (100) automatically rotates the pair of cleaning pads (1, 1') to access different sides of the pair of cleaning pads (1, 1') containing different types of scrubbing pads (15), and wherein the specialized scrubbing brush (100) has capability to cleans the high-rise windows and other hard surfaces from corner to corner and switch from one scrubbing pad (15) to another without human intervention.

The pair of cleaning pads (1, 1') move in opposing directions while oscillating to cancel out the forces on the cleaning pads (1, 1') and reduces vibrations during the overall cleaning process.

The length of attachment gap (2, 2') is less than the amplitude of oscillation preventing uncleaned regions and the said external attachments should oscillate with the system.

The water channel (5) delivers the water to the multiple holes (6) through pipes (4) on one or more sides of the cleaning pads (1, 1') and the water from the water pipes (4) gently pumps into the pair of cleaning pads (1, 1') keeping them saturated with water.

The interface surface (7) is in a zigzag fashion preventing leaving a line of uncleaned surface underneath the scrubbing brush (100).

Each side of the cleaning pad (1 or 1') have same or different type of scrubbing pad (15) attached and the scrubbing pad (15) is selected from the group of plastic scrubbing pad, brush style scrubbing pad, bronze scrub, steel wool, microfiber cloth or glass wool.

In another aspect of the present invention, the invention provides a cleaning equipment (200) for cleaning high-rise windows and other hard surfaces, wherein the equipment (200) comprises:

a specialized scrubbing brush (100);

a pair of oscillating arm (8) with sliding yoke (9) on one arm (8*b*);

a pair of rod shaped guide rails (10);

multiple scrubbing pads (15);

an oscillation mechanism comprising a main gear assembly (11) or one or more motors (19); and a rotation mechanism (A) attached to the specialized scrubbing brush (100), wherein the equipment (200) has capability to cleans the high-rise windows and other hard surfaces from corner to corner, wherein the oscillation mechanism helps the cleaning machine (200) to oscillate a pair of cleaning pads (1, 1') of the specialized scrubbing brush (100) between maximum and minimum distance i.e. between the crest and trough of oscillation motion, wherein the rotation mechanism of the cleaning machine (200) rotates the pair of cleaning pads (1, 1') of the specialized scrubbing brush (100) in circular motion to switch from one scrubbing pad (15) to another which are mounted on the cleaning pads (1, 1') without human intervention.

The oscillation mechanism oscillates the pair of cleaning pads (1, 1') of brush (100) parallel to the axis (3) and the rotation mechanism rotates the pair of cleaning pads (1, 1') about to the axis (3).

The pair of oscillating arm (8) is attached to the specialized scrubbing brush (100) and holds the pair of cleaning pads (1, 1') with a revolute joint allowing the pads to turn when needed.

The pair of oscillating arm (8) comprises of an attachment mechanism (8*c*) present on second arm (8*b*) of the oscillating arms (8) wherein the pair of rod shaped guide rails (10) are fixed in the cleaning equipment (200) in the attachment mechanism (8*c*) and the specialized scrubbing brush (100) slides over the guide rails (10).

The pair of the oscillating arms (8) are connected by the main gear assembly (11) or one or more motors (19) mounted on the opening in the Sliding Yoke (9) and the main gear assembly (11) or one or more motor (19) drives a scotch yoke mechanism to create oscillation in the pair of cleaning pads (1, 1') of specialized scrubbing brush (100).

The rotation mechanism further comprises of a chain (12), pair of sprocket (13) one or more motor (14), a sliding joint (16) and a rod like section (17) which are places between the pairs of cleaning pads (1, 1') of the specialized scrubbing brush (100), and the one or more rotation motor (14) drives a pair of the sprocket (13) that drives the chain (12) which further drives the axis within the pair of cleaning pads (1, 1') by the sliding joint (16).

The above description merely is an outline of the technical solution of the present disclosure. The summary is descriptive and exemplary only and is not intended to be in any way restricting. In order to know the technical means of the present disclosure more clearly so that implementation may be carried out according to contents of the specification, and in order to make the above and other objectives, characteristics and advantages of the present disclosure more clear and easy to understand, specific embodiments of the present invention will be described in detail below.

BRIEF DESCRIPTION OF DRAWINGS

The foregoing and other features of embodiments will become more apparent from the following detailed description of embodiments when read in conjunction with the accompanying drawings. In the drawings, like reference numerals refer to like elements. In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement. In other instances, well-known structures and devices are shown in line diagram form in order to avoid unnecessarily obscuring the embodiments of the invention. In the drawings.

DESCRIPTION OF THE INVENTION

Figure 1:
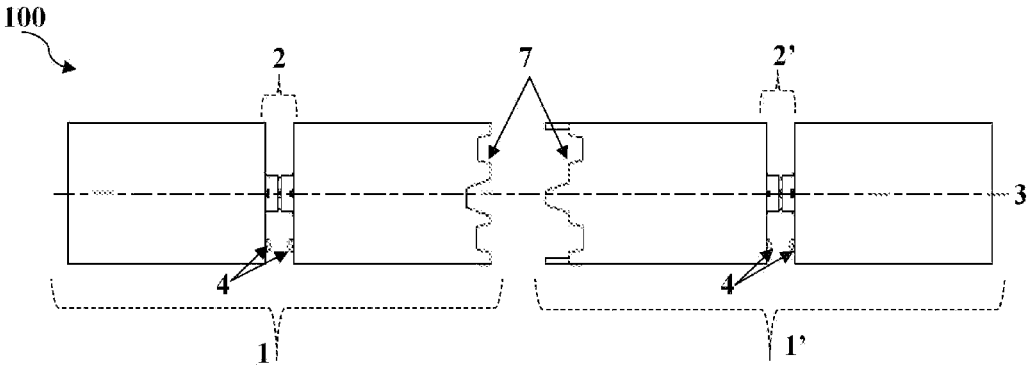
FIG. 1: Shows a pair of square cleaning pads of a specialized scrubbing brush (100) (preferred embodiment) in completely extended position (crest of oscillating motion).

Accordingly, the present invention provides specialized scrubbing brush for cleaning high rise windows and other hard surfaces. The specialized scrubbing brush comprises of cleaning pads of various types and each pad having plurality of scrubbing pads. The provided cleaning pads cleans the high-rise windows and other hard surfaces from corner to corner and the equipment has capability to continuously keep one or more scrubbing pads wet.

Further, provided cleaning equipment with the said specialized scrubbing brush for cleaning high rise windows and other hard surfaces is automatic. The said automatic cleaning equipment with specialized scrubbing brush having cleaning pads of various types has capability to switch from one scrubbing pad to another without human intervention and in the cleaning equipment with specialized scrubbing brush, the surface of the cleaning brush has the provision of supplying water/cleaning fluid.

In one aspect of the present invention, the invention provides a specialized scrubbing brush for cleaning high rise windows and other hard surfaces. FIGS. 1-5 refers to the specialized scrubbing brush (100) for cleaning high-rise windows and other hard surfaces.

Referring to FIGS. 1-5, the specialized scrubbing brush (100) comprises of a pair of cleaning pad (1, 1'), one or more attachment gaps (2, 2') between the each cleaning pad (1, 1'), axis of rotation (3), one or more water pipes (4), one or more water channels (5), plurality of water holes (6) and interface surface (7) between the pair of cleaning pad (1, 1').

The pair of cleaning pads (1, 1') of specialized scrubbing brush (100) of the present invention move in opposing directions while oscillating. This helps cancel out the forces on the cleaning pads (1, 1') and reduces vibrations during the overall cleaning process. Each cleaning pad (1 or 1') is a polygon. Further, in one embodiment of the present invention the shape of the polygon can be of any shape. However, in the preferred embodiment, the polygon is a square shaped polygon. Other polygonal pad structures are also possible and are contemplated within the scope of the invention described.

Multiple scrubbing pads (15) are mounted on the pair of cleaning pads (1, 1'). In one embodiment of the present invention, each side of the cleaning pad (1 or 1') may have a same type of scrubbing pad attached. In another embodiment of the present invention, each side of the cleaning pad (1 or 1') may have a different type of scrubbing pad attached. The scrubbing pad can be any of the pads selected from the group of plastic scrubbing pad, brush style scrubbing pad, bronze scrub, steel wool, microfiber cloth, glass wool etc. The different pads help work with different kind of dirt. Normal dirt should be scrubbed using nylon brush or microfiber cloth. Hard water stains, bird poop and other difficult to remove dirt is better cleaned by high scrub pads like plastic scrub pads, bronze scrub etc.

Further, one or more attachment gaps (2, 2') are provided between each pad (1 or 1') which implies that each pad (1 or 1') of the pair of cleaning pads (1, 1') is itself divided into two halves. The said one or more attachment gaps (2, 2') are provided to attach the cleaning pads (1, 1') to an external system to form a cleaning equipment which is another aspect of the present invention. This attachment gap (2, 2') should be less than the amplitude of oscillation to prevent uncleaned regions. The attachments that attach to the attachment gap should oscillate with the system.

Figure 2:
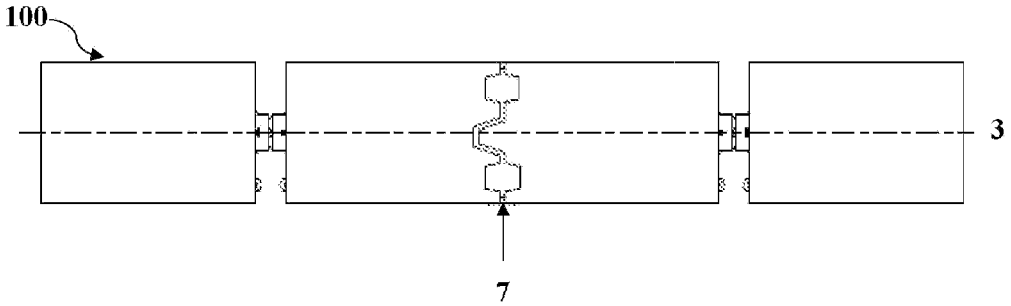
FIG. 2: Shows the same pair of cleaning pads as shown in FIG. 1 in fully contracted position (trough of oscillating motion).

FIGS. 1-2 disclose and show a pair of square cleaning pads (1, 1') of a specialized scrubbing brush (100) (preferred embodiment) that work by oscillation. In FIG. 1 the two pads (1, 1') are shown in their completely extended position (crest of oscillating motion). In FIG. 2 the two pads (1, 1') are shown in their fully contracted position (trough of oscillating motion).

As mentioned above, the pair of cleaning pads (1, 1') of specialized scrubbing brush (100) of the present invention moves in opposing directions while oscillating. The polygon scrubbing brush (100) rotates about an axis (3) within the polygon to switch between the different types of scrubbing pads.

Figure 3:
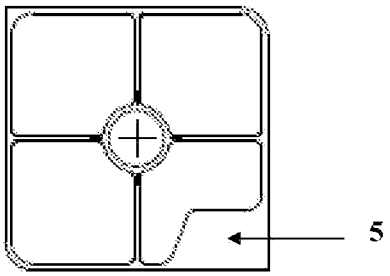
FIG. 3: Shows the side view of the specialized scrubbing brush (100).
Figure 4:
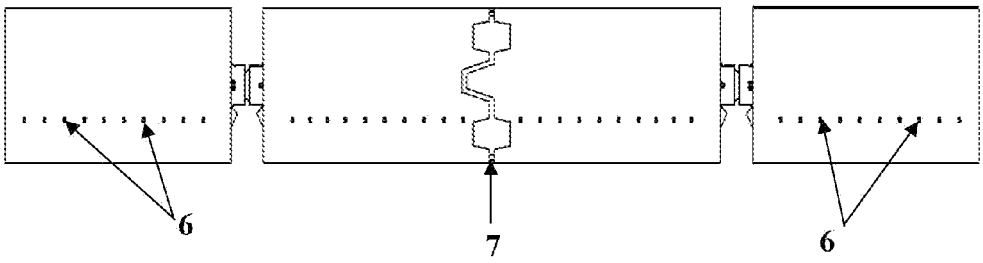
FIG. 4: Shows the view of the surface of the specialized scrubbing brush (100) that has water/cleaning fluid supply.

There are one or more water pipes (4) attached to one or more sides of the polygon/cleaning pads (1, 1') to provide a continuous supply of water to keep the associated pads wet. The one or more water pipes (4) are simply plugged into the ports as shown in diagrams. Further, the said pipes (4) are slack. The water comes from external system (not shown) into the said pipes (4) and then goes into one or more water channel (5) as shown in FIG. 3. Further, the plurality of holes (6) for water are provided on the pair of cleaning pads (1, 1') as can be seen in FIG. 4. The one or more water channel (5) delivers the water to multiple holes (6) through pipes (4) on one or more sides of the polygon/cleaning pads (1, 1'). The water from the water pipes (4) is gently pumped into the pair of cleaning pads (1, 1') to keep them saturated with water.

The wet pad here is referred to the pad with water holes behind it. Since water is ejected continuously into the wet pads, they stay wet. Water can also move within pads and hence unless the pads are separated by a non-porous plastic separator, adjacent faces will have wet pads. Dry pads will eventually get wet if they are used often. However, if they are used sparingly, the evaporation into free air will keep them relatively dry. They are just like the detailing cloth a window cleaner carries. This is a single cloth that a window cleaner uses to remove slight amount of water that is left behind after wiping the glass. Similarly, this cleaning brush has to work in conjugation with a wiper in order to get rid of most of the water. Only final detailing activity which involves removing water from places the wiper cannot reach is done by the dry cloth.

An interface surface (7) is provided between the pair of cleaning pad (1, 1'). The interface surface (7) of the two oscillating cleaning pads (1, 1') is as shown in FIGS. 1, 2, 4 and 5. The usually design of the interface surface (7) is a zigzag fashion. The zigzag fashion is to prevent leaving a line of uncleaned surface underneath the scrubbing brush (100). This interface zig-zag can be designed to allow small holding attachments to also go through and connect the cleaning brush with a body like the cleaning machine.

In one embodiment, the invention provides a specialized scrubbing brush (100) that consists of multiple cleaning pads shaped like a polygon with the ability to rotate the polygon to access different sides of the polygon which may contain different types of scrubbing pads, hence giving the ability to clean using different types of cleaning pads.

Figure 5:
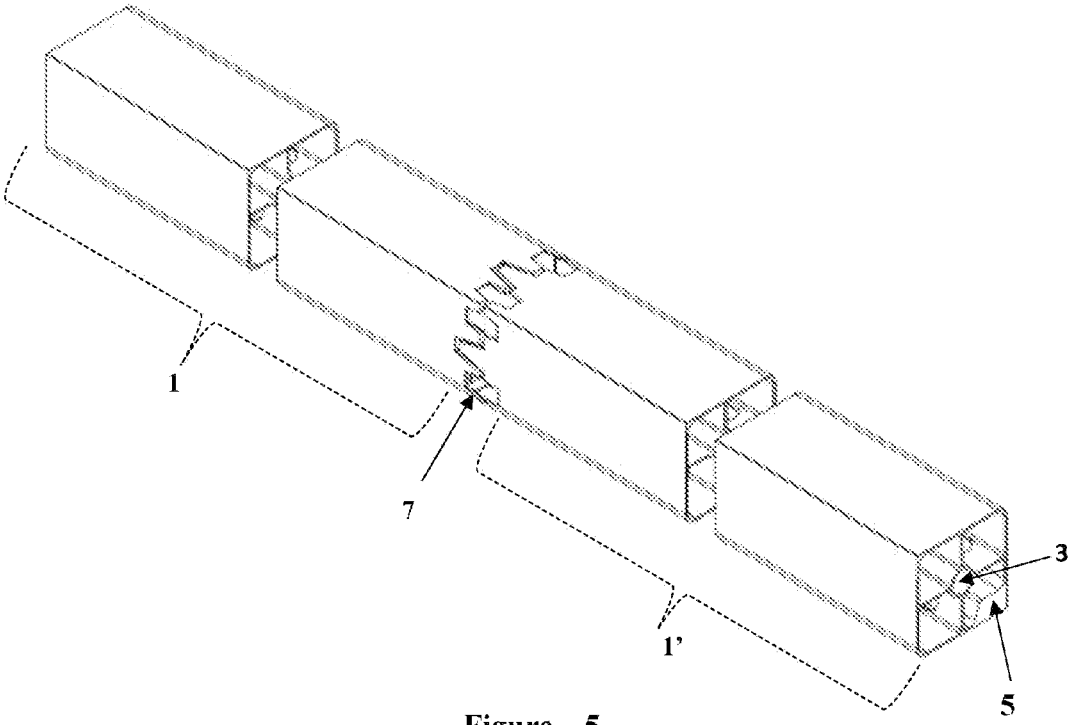
FIG. 5: Shows the isometric view of the specialized scrubbing brush (100).

FIG. 5 further shows the isometric view of the specialized scrubbing brush (100) as described above and as shown in FIGS. 1-4, showing a pair of square pads (1, 1'), axis (3), the water channel (5), and the interface surface (7).

Thus, the above mention description can be summarized as, a specialized scrubbing brush (100) comprises:

- a pair of cleaning pad (1, 1');
- one or more attachment gaps (2, 2') between the each of the cleaning pad (1 or 1');
- an axis of rotation (3);
- one or more water pipes (4);
- one or more water channels (5);
- plurality of water holes (6); and
- an interface surface (7) between the pair of cleaning pad (1, 1'),
- wherein the one or more attachment gaps (2, 2') between the each of the cleaning pad (1, 1') are provided to attach the cleaning pads (1, 1') to an external system;
- wherein the specialized scrubbing brush (100) comprising of a multiple scrubbing pads (15) mounted on the pair of cleaning pads (1, 1') and the said brush (100) automatically rotates the pair of cleaning pads (1, 1') to access different sides of the pair of cleaning pads (1, 1') containing different types of scrubbing pads, and
- wherein the specialized scrubbing brush (100) has capability to cleans the high-rise windows and other hard surfaces from corner to corner and switch from one scrubbing pad to another without human intervention.

In another aspect of the present invention, the present invention provides a cleaning equipment with the said specialized scrubbing brush (100) for cleaning high-rise windows and other hard surfaces. The cleaning equipment is automatic, and various functions for cleaning can work without human intervention.

The Cleaning equipment (200) of the present invention comprises of the specialized scrubbing brush (100), a pair of oscillating arm (8) with sliding yoke (9) on one arm, a pair of rod shaped guide rails (10), scrubbing pads (15), an oscillation mechanism and a rotation mechanism (A) which is attached to the specialized scrubbing brush (100). The oscillation mechanism further comprises of a main gear assembly (11). The rotation mechanism further comprises a chain (12), pair of sprocket (13), one or more motor (14), a sliding joint (16) and a rod like section (17).

The oscillation mechanism helps the cleaning machine (200) to oscillate the pair of cleaning pads (1, 1') between maximum and minimum distance i.e. between the crest and trough of oscillation motion. In other words, the oscillation mechanism moves the pair of cleaning pads (1, 1') in the horizontal motion i.e. parallel to the axis (3). Further, the rotation mechanism of the cleaning machine (200) rotates the pair of cleaning pads (1, 1') in circular motion to switch from one scrubbing pad to another which are mounted on the cleaning pads (1, 1') without human intervention. In other words, the rotation mechanism moves the pair of cleaning pads (1, 1') in the circular motion i.e. about to the axis (3).

Figure 6:
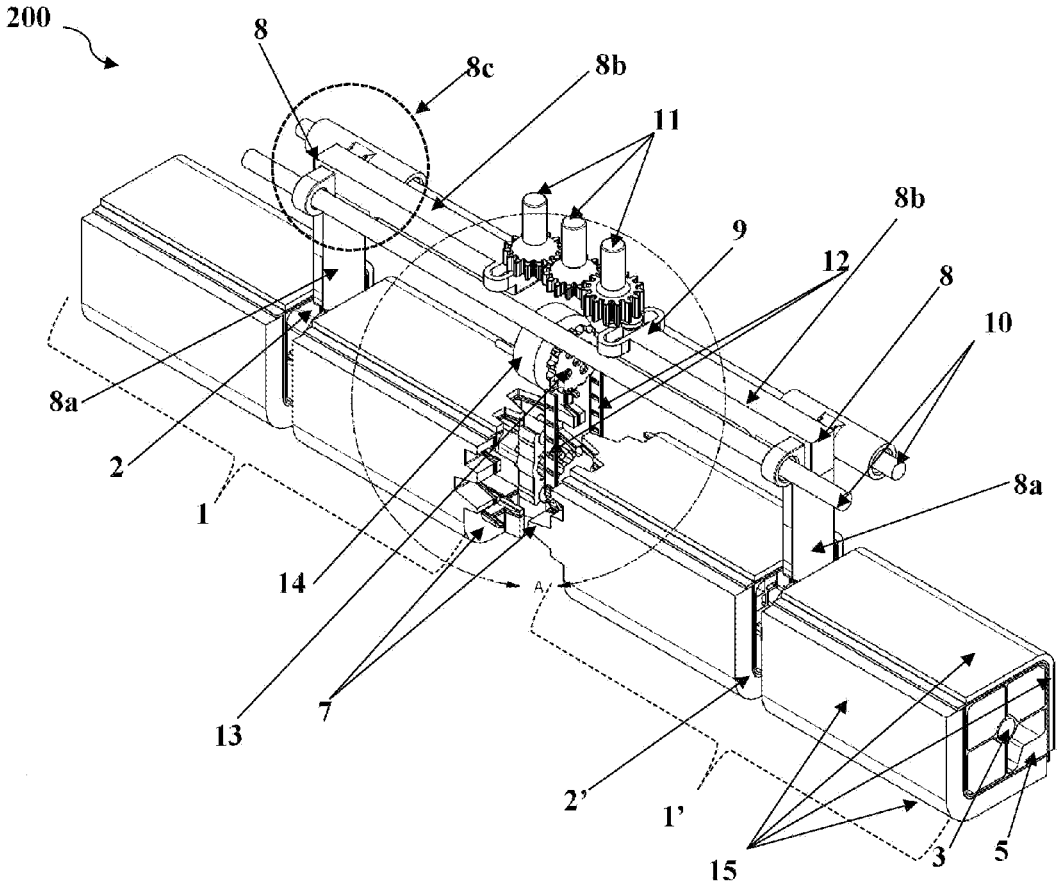
FIG. 6: Shows a cleaning equipment (200) employing the said specialized scrubbing brush (100) of FIG. 1.

Referring to FIG. 6 of the present invention, FIG. 6 shows a complete cleaning equipment assembly (200). The pair of oscillating arm (8) is L-shaped rod like structures which are attached to the specialized scrubbing brush (100). These arms hold the pair of cleaning pads (1, 1') with a revolute joint allowing the pads to turn when needed. One arm (8*a*) of one of the oscillating arm (8) in the pair is fixed in the attachment gaps (2) of pad (1) of the pair of cleaning pads (1, 1'). Similarly, one arm (8*a*) of the remaining oscillating arm (8) is fixed in the attachment gaps (2') of pad (1') of the pair of cleaning pads (1, 1'). A Sliding Yoke (9) is present on other/second arm (8*b*) of the oscillating arms (8). An attachment mechanism (8*c*) is also present on second arm (8*b*) of the oscillating arms (8) where a pair of rod shaped guide rails (10) are fixed in the cleaning equipment (200).

Figure 10:
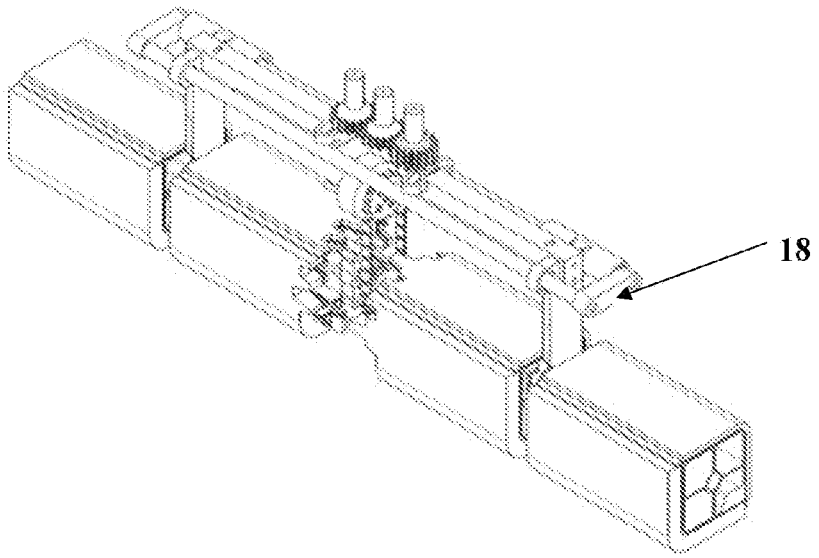
FIG. 10: Shows one of the embodiment of the cleaning equipment (200) of FIG. 6 with a hard attachment (18).

The specialized scrubbing brush (100) connected using the pair of oscillating arms (8) slides over the guide rails (10). The Guide rails (10) can be mounted to an external robot body. FIG. 10 shows one such mounting method in which a hard attachment (18) can be used. For better results, a compliant attachment may be used.

As mentioned above, FIG. 2 shows the pair of cleaning pads (1, 1') when they are at minimum distance. Together FIG. 1 and FIG. 2 show the extremes of the oscillation. The scrubbing pad (15) are mounted on the pair of cleaning pads (1, 1'). Any commercial application of this cleaning system may involve replaceable cleaning pads.

Further, cleaning equipment (200) comprises of an oscillating mechanism. The oscillating mechanism further comprises of a main gear assembly (11). The pair of the oscillating arms (8) are connected using main gear assembly (11). The main gear assembly (11) is fixed into the opening in the Sliding Yoke (9). The main gear assembly (11) are driven to create oscillation in the pair of cleaning pads (1, 1') of specialized scrubbing brush (100). This drives a scotch yoke mechanism. The Scotch Yoke mechanism is a reciprocating motion mechanism, converting the linear motion of a slider into rotational motion, or vice versa. The piston or other reciprocating part is directly coupled to a sliding yoke with a slot that engages a pin on the rotating part. This mechanism further drives the attached pair of cleaning pads (1, 1') thus creating an oscillating motion.

Figure 7:
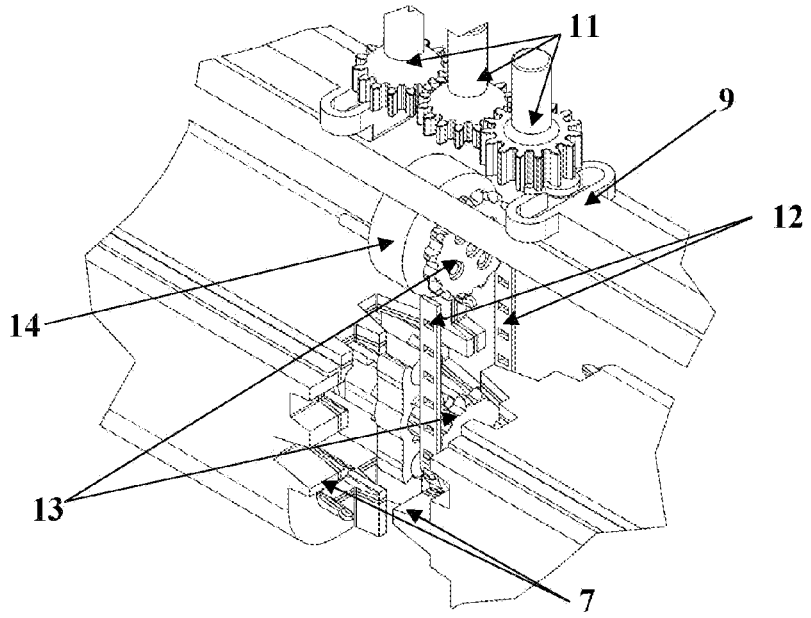
FIG. 7: Shows a close up view of the rotation mechanism (A) of the cleaning equipment (200) of FIG. 6.
Figure 8:
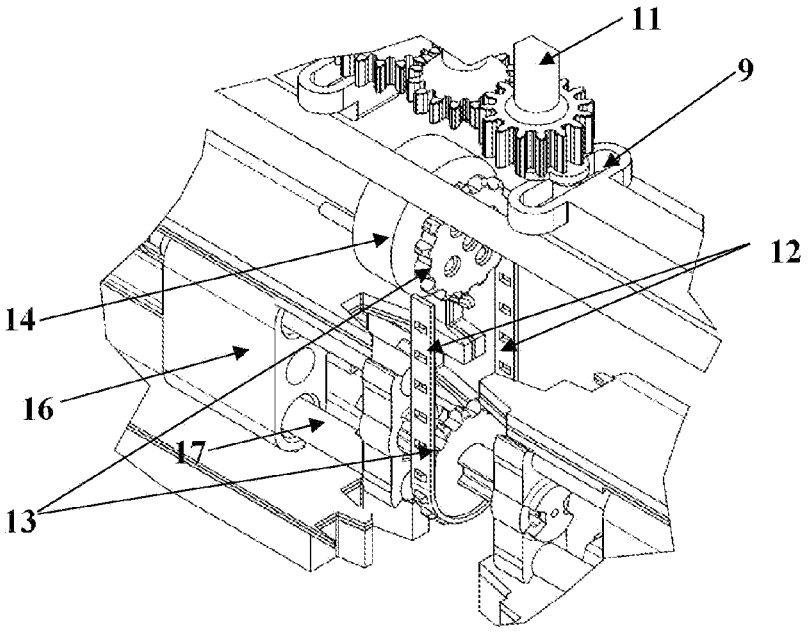
FIG. 8: Shows a zoomed in isometric sliced view into the cleaning pads showing the rotation mechanism (A).

Further, as shown in a close up view of the rotation mechanism of FIG. 7 and a zoomed in isometric sliced view into the cleaning pads of FIG. 8, the chain (12), pair of sprocket (13) and a motor (14) are placed between the pairs of cleaning pads (1, 1'). This helps to achieve the rotation mechanism of the cleaning machine (200) i.e. the equipment rotates the pair of cleaning pads (1, 1') in circular motion to switch from one scrubbing pad to another which are mounted on the cleaning pads (1, 1') without human intervention. The motor (13) is mounted in the equipment. One sprocket in the pair of sprocket (13) is mounted on the motor (13) wherein another sprocket is connected with the cleaning pads via a sliding link (16). The chain (12) is used to connect the two sprocket of the pair. The sliding link (16) is connected between within cleaning pads. This slides on a rod like section (17) attached to the sprocket (13).

Figure 9:
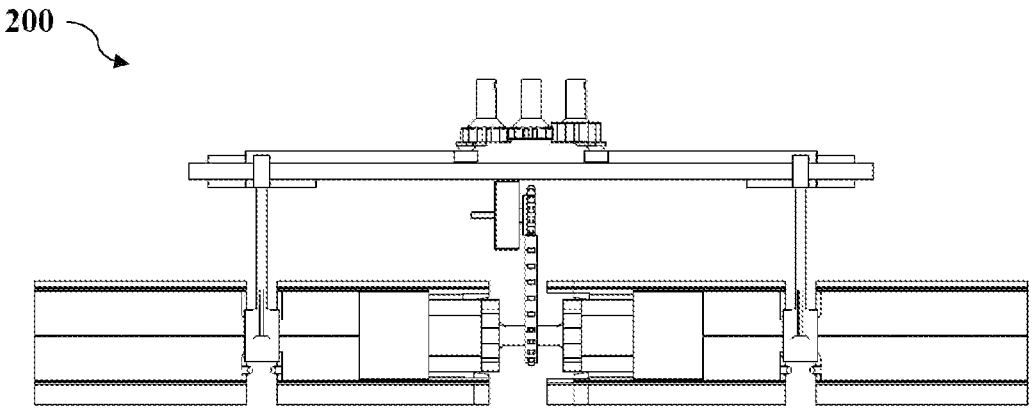
FIG. 9: Shows a front view of sliced cleaning equipment.

When the motor rotates, the sprocket connected to the motor rotates and consequently the chain (12) connected to the sprocket rotates. The rotation of the chain (12) rotates the sprocket connected to the cleaning pads (1, 1') via sliding links (16). Thus, the rotation of motor (13) results in the rotation of the pair of cleaning pads (1, 1') and change between different scrubbing pads (15). FIG. 9 shows a front view of sliced cleaning pads.

Figure 11A:
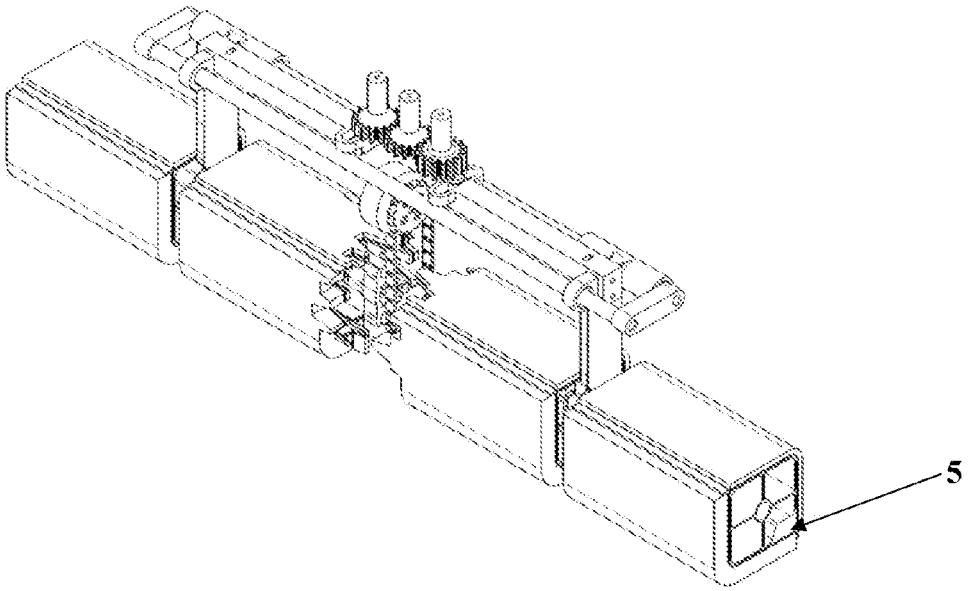
FIG. 11A-11C: Shows one of the example embodiment of the cleaning equipment (200) of FIG. 6 wherein the figure shows the rotation of cleaning pads.
Figure 11B:
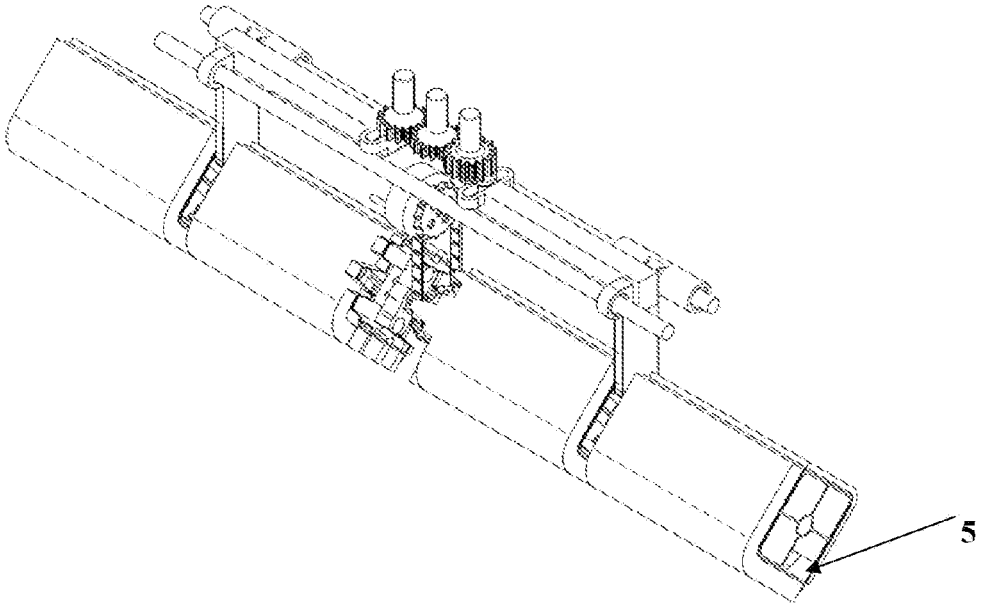
Figure 11C:
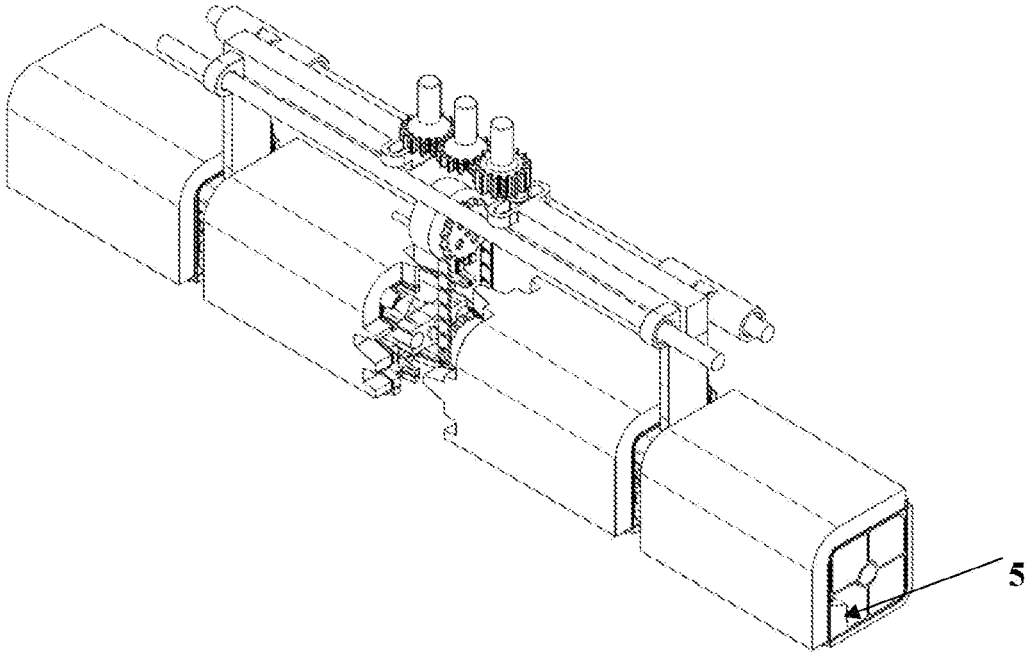

FIG. 11A-11C shows the stages of rotation of the pair of cleaning pads (1, 1'). In the figures, the pairs are rotated in the clockwise direction. The same can be confirmed from the position of one or more water chamber (5). The water chamber (5) which is at the right side of the cleaning pads (in FIG. 11A) rotates to left side of the cleaning pads (as shown in FIG. 11C).

Thus, the above mention description can be summarized as, a cleaning equipment with the said specialized scrubbing brush (100) for cleaning high-rise windows and other hard surfaces comprises:

- a specialized scrubbing brush (100);
- a pair of oscillating arm (8) with sliding yoke (9) on one arm (8*b*);
- a pair of rod shaped guide rails (10);
- multiple scrubbing pads (15);
- an oscillation mechanism comprising a main gear assembly (11); and
- a rotation mechanism (A) attached to the specialized scrubbing brush (100),
- wherein the equipment (200) has capability to clean the high-rise windows and other hard surfaces from corner to corner,
- wherein the oscillation mechanism helps the cleaning machine (200) to oscillate a pair of cleaning pads (1, 1') of the specialized scrubbing brush (100) between maximum and minimum distance i.e. between the crest and trough of oscillation motion,
- wherein the rotation mechanism of the cleaning machine (200) rotates the pair of cleaning pads (1, 1') of the specialized scrubbing brush (100) in circular motion to switch from one scrubbing pad to another which are mounted on the cleaning pads (1, 1') without human intervention.

Figure 12:
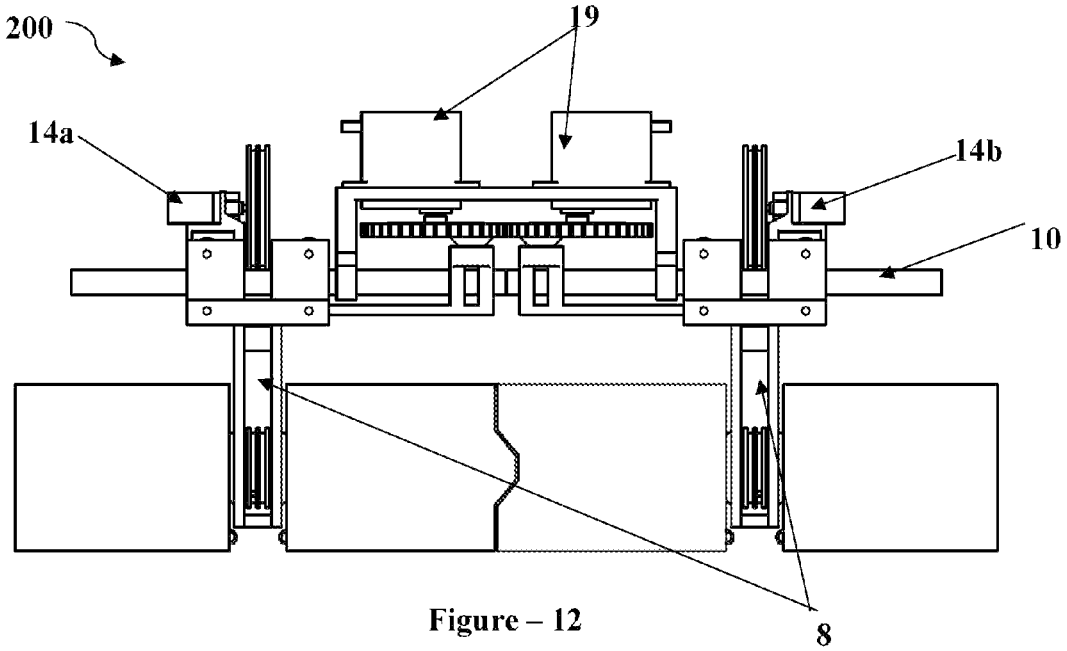
FIG. 12: Shows a cleaning equipment (200) in the alternate design in front view.
Figure 13:
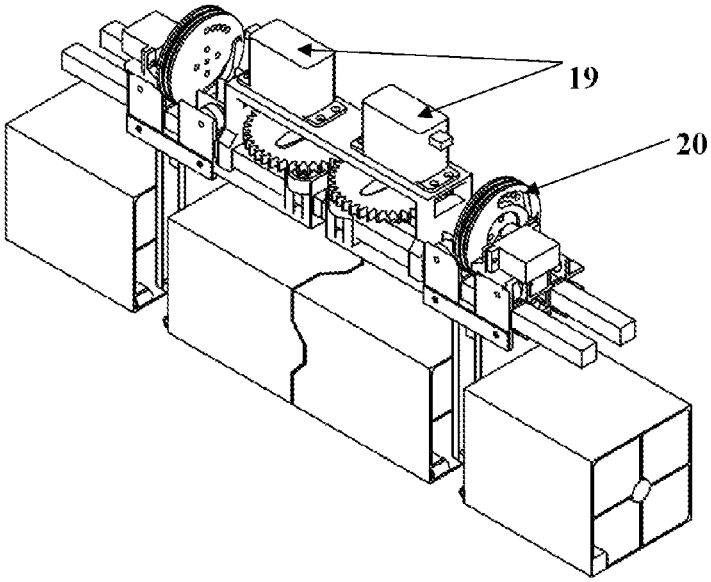
FIG. 13: Shows a cleaning equipment (200) in the alternate design in isometric view.

Referring to FIGS. 12 and 13 of the present invention, FIGS. 12 and 13 referred to an alternative variation of cleaning equipment (200). In this embodiment, the equipment (200) uses two cleaning pad rotation motors (14*a* and 14*b*) and two pulleys (20) are used to achieve the rotation mechanism. The said two cleaning pad rotation motors (14*a* and 14*b*) are mounted on each of the oscillating arms (8) are two pulleys (20) are mounted on the sides of the said motors (14*a*, 14*b*). Further, the cleaning equipment (200) is the use of multiple motors (19) for driving the scotch yoke mechanisms in place of main gear assembly (11). In one preferred embodiment, the sliding rods (10) are square shaped rod. Using the multiple motors (19), the oscillation mechanism is achieved. This alternative variation embodiment (200) is simpler but requires the motors 14*a* and 14*b* to be coordinated.

Thus, the present invention provides a specialized scrubbing brush for cleaning high rise windows and other hard surfaces comprising of cleaning pads of various types and each pad having plurality of scrubbing pads.

Further, the present invention also provided a cleaning equipment with the said specialized scrubbing brush for cleaning high rise windows and other hard surfaces. The said automatic cleaning equipment with specialized scrubbing brush having cleaning pads of various types has capability to switch from one scrubbing pad to another without human intervention.

APPLICATION AND/OR ADVANTAGES

- The cleaning brush can be used to do corner to corner cleaning with the added ability to change between a finite selections of cleaning pad types without human intervention.
- The provided cleaning pads cleans the high-rise windows and other hard surfaces from corner to corner and the equipment has capability to continuously keep one or more scrubbing pads wet.
- In the cleaning equipment with specialized scrubbing brush, the surface of the cleaning brush has the provision of supplying water/cleaning fluid.

We claim:

1. A specialized scrubbing brush for cleaning high-rise windows and other hard surfaces, wherein the specialized scrubbing brush comprises:

- a pair of cleaning pads;
- one or more attachment gaps between the each of the cleaning pads;
- an axis of rotation;
- one or more water pipes;
- one or more water channels;
- a plurality of water holes; and
- an interface surface between the pair of cleaning pads,
- wherein the one or more attachment gaps between the each of the cleaning pads are provided to attach the cleaning pads to an external system;
- wherein the specialized scrubbing brush comprises multiple scrubbing pads mounted on the pair of cleaning pads and the pair of cleaning pads is automatically rotatable to access different sides of the pair of cleaning pads containing different types of the multiple scrubbing pads, and
- wherein the specialized scrubbing brush has a capability to clean the high-rise windows and other hard surfaces from corner to corner and switch from one of the multiple scrubbing pads to another one of the multiple scrubbing pads without human intervention.

2. The specialized scrubbing brush as claimed in claim 1, wherein the pair of cleaning pads are movable in opposing directions while oscillating to cancel out forces on the cleaning pads and to reduce vibrations during an overall cleaning process.

3. The specialized scrubbing brush as claimed in claim 1, wherein a length of the one or more attachment gaps is less than an amplitude of oscillation of the specialized scrubbing brush.

4. The specialized scrubbing brush as claimed in claim 1, wherein the water channel is arranged to deliver water to the plurality of water holes through pipes on one or more sides of the cleaning pads.

5. The specialized scrubbing brush as claimed in claim 1, wherein the interface surface is in a zigzag fashion preventing leaving a line of uncleaned surface underneath the scrubbing brush.

6. The specialized scrubbing brush as claimed in claim 1, wherein the pair of cleaning pads each have multiple sides, and each side of the pair of cleaning pads has a same or different type of the multiple scrubbing pads attached, and each of the multiple scrubbing pads is selected from the group consisting of a plastic scrubbing pad, a brush style scrubbing pad, a bronze scrub, steel wool, microfiber cloth or glass wool.

7. A cleaning equipment for cleaning high-rise windows and other hard surfaces, wherein the cleaning equipment comprises:

a specialized scrubbing brush as claimed in claim 1;

a pair of oscillating arms with a sliding yoke on one of the arms;

a pair of rod shaped guide rails;

an oscillation mechanism comprising at least one of a main gear assembly or one or more motors; and a rotation mechanism attached to the specialized scrubbing brush, wherein the equipment has a capability to clean the high-rise windows and other hard surfaces from corner to corner, wherein the oscillation mechanism is connected to oscillate the pair of cleaning pads of the specialized scrubbing brush between a crest and trough of an oscillation motion, wherein the rotation mechanism is connected to rotate the pair of cleaning pads in a circular motion to switch from one of the multiple scrubbing pads to another one of the multiple scrubbing pads which are mounted on the cleaning pads without human intervention.

8. The cleaning equipment as claimed in claim 7, wherein the oscillation mechanism oscillates the pair of cleaning pads parallel to an axis and the rotation mechanism rotates the pair of cleaning pads about to the axis.

9. The cleaning equipment as claimed in claim 7, wherein the pair of oscillating arms is attached to the specialized scrubbing brush and holds the pair of cleaning pads with a revolute joint allowing the pads to turn when needed.

10. The cleaning equipment as claimed in claim 7, wherein the pair of oscillating arms comprises an attachment mechanism present on one of the arms of the pair of oscillating arms, wherein the pair of rod shaped guide rails are fixed in the cleaning equipment in the attachment mechanism and the specialized scrubbing brush slides over the guide rails.

11. The cleaning equipment as claimed in claim 7, wherein the pair of the oscillating arms are connected by the main gear assembly or the one or more motors mounted on an opening in the sliding yoke and the main gear assembly or the one or more motors drives a scotch yoke mechanism to create oscillation in the pair of cleaning pads of specialized scrubbing brush.

12. The cleaning equipment as claimed in claim 7, wherein the rotation mechanism further comprises of a chain, pair of sprockets, one or more rotation motors, a sliding joint and a rod-shaped section which are placed between the pairs of cleaning pads of the specialized scrubbing brush, and wherein the one or more rotation motors drives a pair of the sprockets that drives the chain which further drives the axis within the pair of cleaning pads by the sliding joint.

* * * * *